US009640917B1

(12) United States Patent
Li et al.

(10) Patent No.: US 9,640,917 B1
(45) Date of Patent: May 2, 2017

(54) ELECTRICAL CONNECTOR

(71) Applicant: Cheng Uei Precision Industry Co., Ltd., New Taipei (TW)

(72) Inventors: Qing-Liang Li, Dong-Guan (CN); Zhu-Rui Liu, Dong-Guan (CN); Jui-Ming Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/185,046

(22) Filed: Jun. 17, 2016

(51) Int. Cl.
*H01R 13/648* (2006.01)
*H01R 13/6581* (2011.01)
*H01R 24/60* (2011.01)

(52) U.S. Cl.
CPC ..... *H01R 13/6581* (2013.01); *H01R 24/60* (2013.01)

(58) Field of Classification Search
CPC ..... H01R 13/6581; H01R 24/60
USPC ..... 439/79, 607.35–607.4, 660
See application file for complete search history.

(56) References Cited

U.S. PATENT DOCUMENTS 7,108,552 B2 * 9/2006 Niitsu ..... H01R 23/6873 439/607.35
7,789,706 B2 * 9/2010 Chen ..... H01R 13/504 439/607.35
7,811,127 B2 * 10/2010 Tsuzaki ..... H01R 23/6873 439/607.01
8,932,081 B2 * 1/2015 Kamarauskas ..... H01R 13/41 439/607.35
2014/0315446 A1 * 10/2014 He ..... H01R 13/504 439/701

* cited by examiner

*Primary Examiner* — Khiem Nguyen
(74) *Attorney, Agent, or Firm* — Cheng-Ju Chiang

(57) ABSTRACT

An electrical connector includes an insulating housing, a plurality of terminals located in the insulating housing, a main shielding shell and an auxiliary shell. The insulating housing has a main body, and a tongue portion protruded frontward from a front surface of the main body. The main shielding shell surrounds the main body and the tongue portion of the insulating housing. The main shielding shell has a main plate, a bottom plate and two lateral plates. A middle of the bottom plate defines an avoiding gap. The auxiliary shell has a base plate, and two flanks extended outward from two opposite sides of the base plate. The two flanks are fastened to bottom surfaces of two side walls of the avoiding gap and the base plate is located under the avoiding gap.

13 Claims, 5 Drawing Sheets

ELECTRICAL CONNECTOR

BACKGROUND OF THE INVENTION

1. Field of the Invention

The present invention generally relates to a connector, and more particularly to an electrical connector.

2. The Related Art

A conventional electrical connector includes an insulating housing, a plurality of terminals and a shielding shell. The insulating housing has a base board disposed vertically, and a tongue board protruded frontward from a front surface of the base board. The insulating housing defines a plurality of terminal grooves penetrating upward through a top surface of the tongue board, extending longitudinally and further penetrating downward through the base board. The terminals are assembled to the terminal grooves. The shielding shell surrounds the insulating housing together with the terminals. An insertion space is formed between the shielding shell and the insulating housing. A butting connector is inserted into the insertion space of the electrical connector.

However, with a characteristic of a volume and a thickness of the electrical connector being smaller and smaller, strength of the electrical connector becomes weaker, when the butting connector is inserted into the insertion space again and again, in order to ensure the strength of the electrical connector to make the electrical connector have a more stable structure, strength of the shielding shell of the electrical connector need be enhanced.

SUMMARY OF THE INVENTION

An object of the present invention is to provide an electrical connector. The electrical connector includes an insulating housing, a plurality of terminals located in the insulating housing, a main shielding shell and an auxiliary shell. The insulating housing has a main body, and a tongue portion protruded frontward from a front surface of the main body. The main shielding shell surrounds the main body and the tongue portion of the insulating housing. The main shielding shell has a main plate, a bottom plate and two lateral plates. An insertion space is formed among the main plate, the bottom plate, the two lateral plates and the tongue portion of the insulating housing. A middle of the bottom plate defines an avoiding gap penetrating a front edge thereof. The auxiliary shell has a base plate, and two flanks extended outward from two opposite sides of the base plate. And the base plate is concaved downward with respect to the two flanks. The two flanks are fastened to bottom surfaces of two side walls of the avoiding gap and the base plate is located under the avoiding gap.

As described above, the auxiliary shell has the base plate, and the two flanks extended outward from the two opposite sides of the base plate, and the base plate is concaved downward with respect to the two flanks, the two flanks are fastened to the bottom surfaces of the two side walls of the avoiding gap and the base plate is located under the avoiding gap, in this way, the auxiliary shell is fastened to the main shielding shell, so that strength of the main shielding shell is enhanced to ensure strength of the electrical connector. Thus, the electrical connector has a more stable structure.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
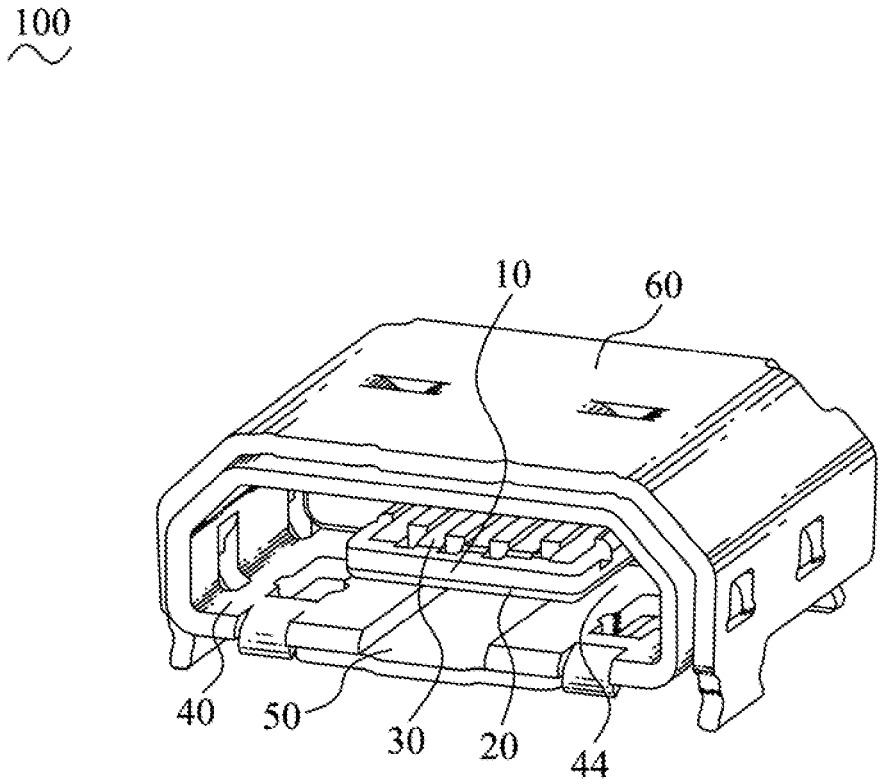
FIG. 1 is a perspective view of an electrical connector in accordance with an embodiment of the present invention.
Figure 2:
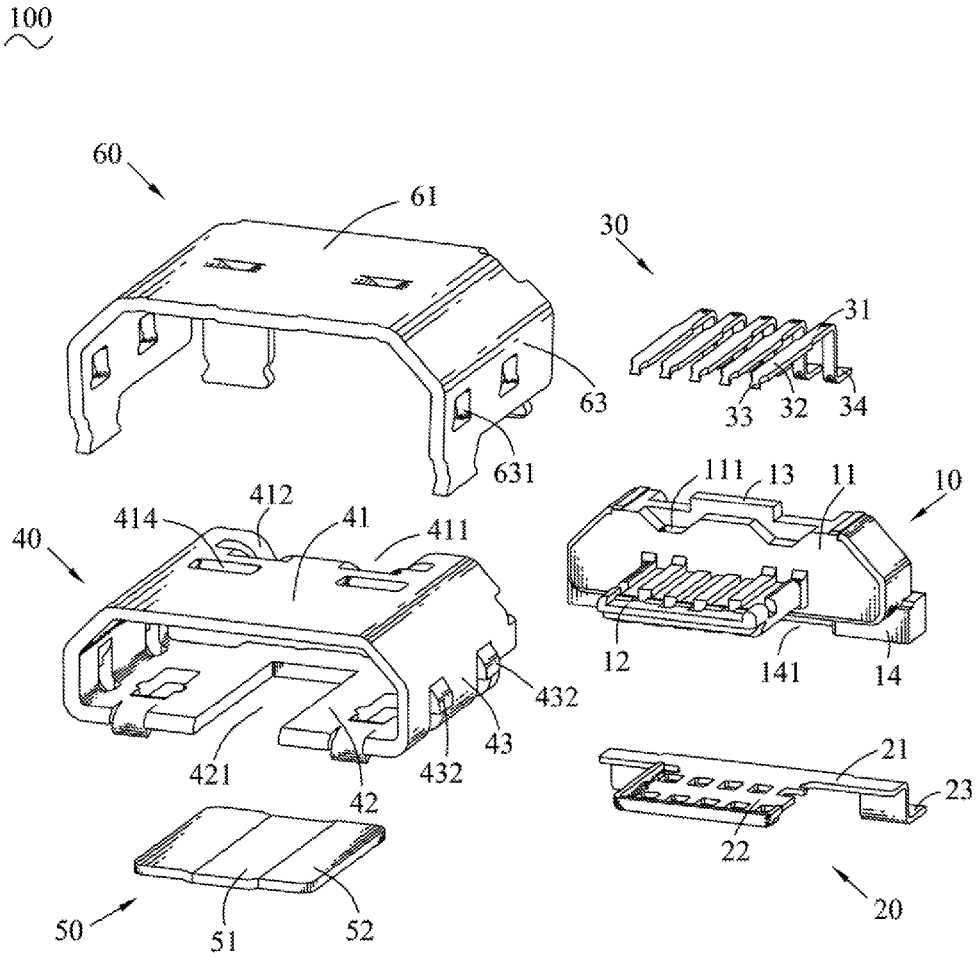
FIG. 2 is an exploded view of the electrical connector of FIG. 1.
Figure 3:
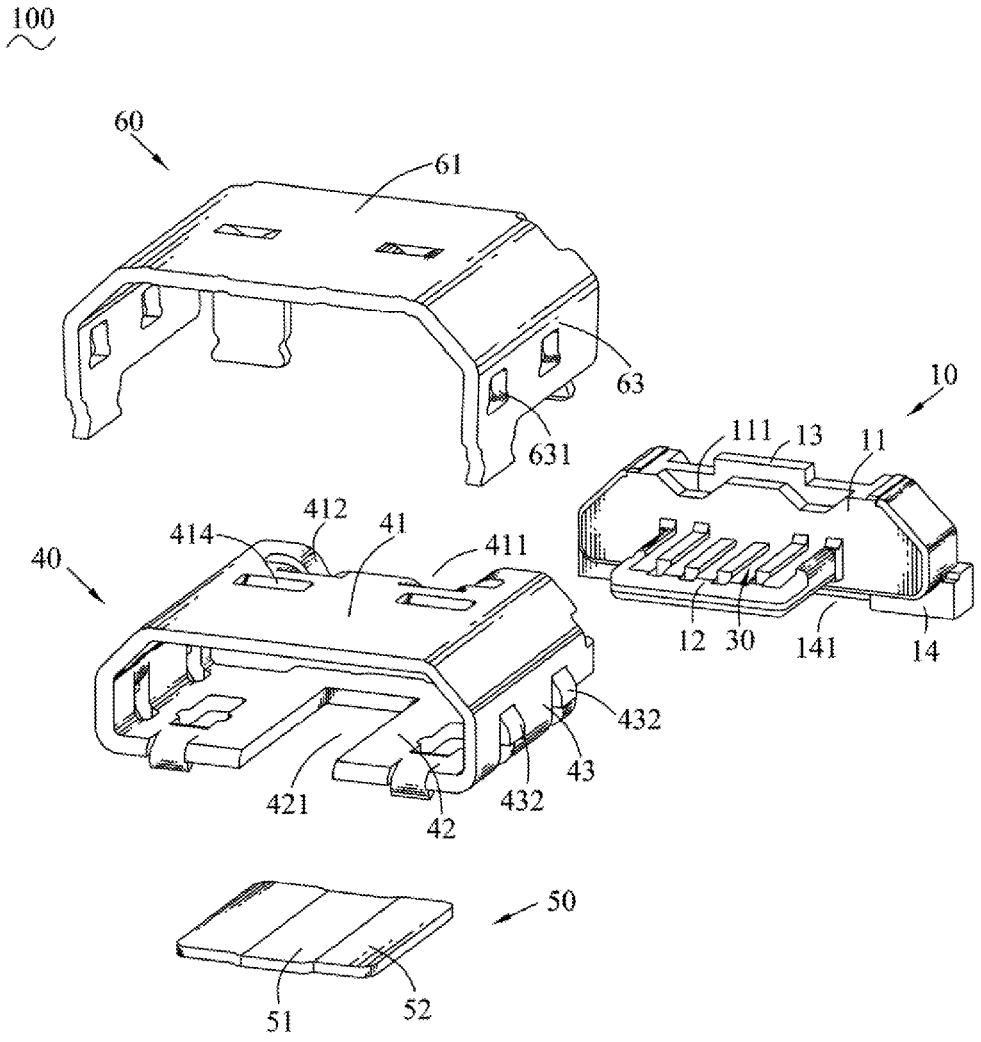
FIG. 3 is a partially exploded view of the electrical connector of FIG. 1.
Figure 4:
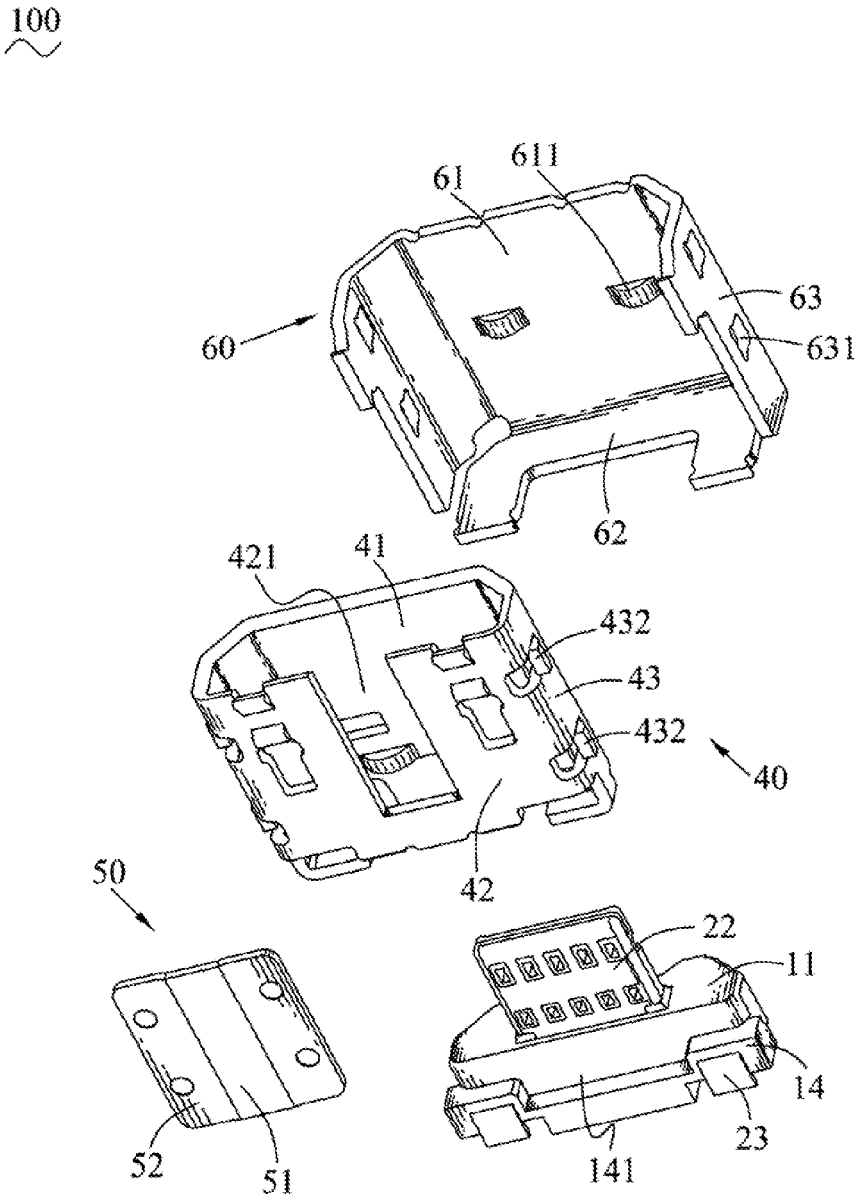
FIG. 4 is another partially exploded view of the electrical connector of FIG. 1.
Figure 5:
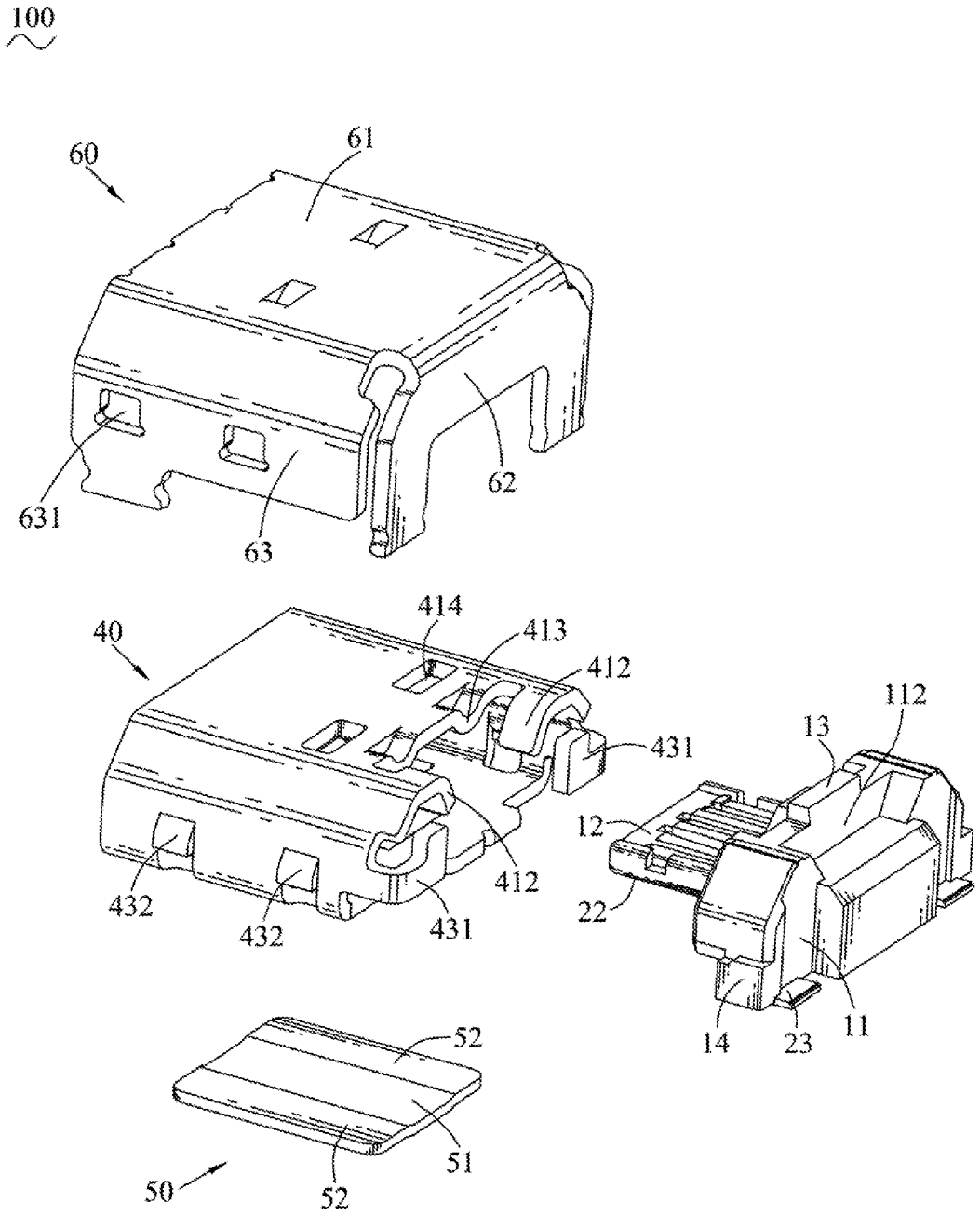
FIG. 5 is one other partially exploded view of the electrical connector of FIG. 1.

With reference to FIG. 1, an electrical connector 100 in accordance with an embodiment of the present invention is shown. The electrical connector 100 includes an insulating housing 10, an auxiliary body 20, a plurality of terminals 30, a main shielding shell 40 and an auxiliary shell 50.

Referring to FIG. 1 to FIG. 5, the insulating housing 10 has a main body 11, and a tongue portion 12 protruded frontward from a front surface of the main body 11. A middle of a top surface of the main body 11 protrudes upward to form a protruding block 13. Lower portions of two side surfaces and a bottom surface of the main body 11 protrude outward to form a protruding step 14. A front surface of the protruding step 14 is recessed inward to form a receiving groove 141. At least one portion of the top surface of the main body 11 located in front of the protruding block 13 is recessed downward to form a first recess 111. At least one portion of the top surface of the main body 11 located behind the protruding block 13 is recessed downward to form a second recess 112.

The auxiliary body 20 has a base portion 21 integrally molded in the main body 11. A front end of the base portion 21 protrudes frontward to form a tongue board 22. Two opposite sides of a rear end of the base portion 21 are bent downward and then bent rearward to form two soldering feet 23. The tongue board 22 is integrally molded under the tongue portion 12. One part of each of the two soldering feet 23 is integrally molded in the main body 11. The other part of each of the two soldering feet 23 projects out of the main body 11. Specifically, a rear of each of the two soldering feet 23 projects beyond a rear surface of the main body 11 and a bottom of each of the two soldering feet 23 projects beyond a bottom surface of the protruding step 14.

The terminals 30 are located in the insulating housing 10. Specifically, the terminals 30 are integrally molded in the insulating housing 10. Each of the terminals 30 has an elongated fastening portion 31, a contact portion 32 extended frontward from a front end of the fastening portion 31, and a bending portion 33 bent frontward and downward from a tail end of the contact portion 32, and a soldering portion 34 bent downward and then bent rearward from a rear end of the fastening portion 31. The fastening portion 31 and one part of the soldering portion 34 are integrally molded in the main body 11. The contact portion 32 is integrally molded in the tongue portion 12 and exposed to a top surface of the tongue portion 12. The other part of the soldering portion 34 projects out of the main body 11. Specifically, a rear of the soldering portion 34 projects beyond the rear surface of the main body 11. A bottom surface of the soldering portion 34 is exposed beyond a bottom surface of the protruding step 14.

The main shielding shell 40 has a main plate 41, a bottom plate 42 and two lateral plates 43. A middle of the bottom plate 42 defines an avoiding gap 421 penetrating a front edge thereof. Specifically, a rear end of the main plate 41 of the main shielding shell 40 opens an opening 411. Two inner sides of two opposite side walls of the opening 411 are bent inward and downward to form two hooking portions 412. At least one portion of the rear end of the main plate 41 of the main shielding shell 40 is punched downward to form at least one buckling portion 413. The main plate 41 opens at least one fastening hole 414. Rear ends of the two lateral plates 43 of the main shielding shell 40 extend rearward and then are bent inward to form two blocking arms 431. At least one portion of each of the two lateral plates 43 is punched outward to form at least one fixing portion 432.

The auxiliary shell 50 has a base plate 51, and two flanks 52 extended outward from two opposite sides of the base plate 51. The base plate 51 is concaved downward with respect to the two flanks 52. Specifically, the two flanks 52 are bent upward and then extended outward from the two opposite sides of the base plate 51.

The electrical connector 100 further includes a cover 60. The cover 60 has a plate-shaped top plate 61, a rear plate 62 bent downward from a rear end of the top plate 61, and two side plates 63 bent downward from two opposite sides of the top plate 61. At least one portion of the top plate 61 is punched downward to form a convex portion 611. Each of the side plates 63 opens at least one fixing groove 631.

Referring to FIG. 1 to FIG. 5, when the electrical connector 100 is assembled, firstly, the auxiliary body 20 and the terminals 30 are integrally molded in the insulating housing 10. Then the main shielding shell 40 surrounds the insulating housing 10. Specifically, the main shielding shell 40 surrounds the main body 11 and the tongue portion 12 of the insulating housing 10. An insertion space 44 is formed among the main plate 41, the bottom plate 42, the two lateral plates 43 and the tongue portion 12 of the insulating housing 10. A rear end of the bottom plate 42 of the main shielding shell 40 is received in the receiving groove 141. The buckling portion 413 is buckled in the first recess 111. The two hooking portions 412 hook two side walls of the second recess 112. The two blocking arms 431 block the rear surface of the main body 11. A top surface of the main shielding shell 40 is flush with a top surface of the protruding block 13.

The auxiliary shell 50 is fastened to the main shielding shell 40. Specifically, the two flanks 52 are fastened to bottom surfaces of two side walls of the avoiding gap 421. The base plate 51 is located under the avoiding gap 421. The flanks 52 are fastened to the main shielding shell 40 by laser welding. At last, the cover 60 is covered on the main shielding shell 40. The top plate 61 is covered on the main plate 41 of the main shielding shell 40. The convex portion 611 is fastened in the fastening hole 414. The fixing portion 432 is fixed in the fixing groove 631, so that the cover 60 is fastened to the main shielding shell 40. The electrical connector 100 is soldered to a printed circuit board (not shown) by use of the cover 60.

As described above, the auxiliary shell 50 has the base plate 51, and the two flanks 52 extended outward from the two opposite sides of the base plate 51, and the base plate 51 is concaved downward with respect to the two flanks 52, the two flanks 52 are fastened to the bottom surfaces of the two side walls of the avoiding gap 421 and the base plate 51 is located under the avoiding gap 421, in this way, the auxiliary shell 50 is fastened to the main shielding shell 40, so that strength of the main shielding shell 40 is enhanced to ensure strength of the electrical connector 100. Thus, the electrical connector 100 has a more stable structure.

What is claimed is:

1. An electrical connector, comprising:

an insulating housing having a main body, and a tongue portion protruded frontward from a front surface of the main body;

a plurality of terminals located in the insulating housing;

a main shielding shell surrounding the main body and the tongue portion of the insulating housing, the main shielding shell having a main plate, a bottom plate and two lateral plates, an insertion space being formed among the main plate, the bottom plate, the two lateral plates and the tongue portion of the insulating housing, a middle of the bottom plate defining an avoiding gap penetrating a front edge thereof; and an auxiliary shell having a base plate, and two flanks extended outward from two opposite sides of the base plate, and the base plate being concaved downward with respect to the two flanks, the two flanks being fastened to bottom surfaces of two side walls of the avoiding gap and the base plate being located under the avoiding gap.

2. The electrical connector as claimed in claim 1, further comprising an auxiliary body, the auxiliary body having a base portion integrally molded in the main body, a front end of the base portion protruding frontward to form a tongue board, the tongue board being integrally molded under the tongue portion.

3. The electrical connector as claimed in claim 2, wherein two opposite sides of a rear end of the base portion are bent downward and then bent rearward to form two soldering feet, one part of each of the two soldering feet is integrally molded in the main body, the other part of each of the two soldering feet projects out of the main body.

4. The electrical connector as claimed in claim 3, wherein lower portions of two side surfaces and a bottom surface of the main body protrude outward to form a protruding step, a rear of each of the two soldering feet projects beyond a rear surface of the main body and a bottom of each of the two soldering feet projects beyond a bottom surface of the protruding step.

5. The electrical connector as claimed in claim 1, wherein each of the terminals has a fastening portion, a contact portion extended frontward from a front end of the fastening portion, and a bending portion bent frontward and downward from a tail end of the contact portion, and a soldering portion bent downward and then bent rearward from a rear end of the fastening portion, the fastening portion and one part of the soldering portion are integrally molded in the main body, the contact portion is integrally molded in the tongue portion and exposed to a top surface of the tongue portion, the other part of the soldering portion projects out of the main body.

6. The electrical connector as claimed in claim 5, wherein lower portions of two side surfaces and a bottom surface of the main body protrude outward to form a protruding step, a rear of the soldering portion projects beyond the rear surface of the main body, a bottom surface of the soldering portion is exposed beyond a bottom surface of the protruding step.

7. The electrical connector as claimed in claim 1, wherein a middle of a top surface of the main body protrudes upward to form a protruding block, at least one portion of the top surface of the main body located in front of the protruding block is recessed downward to form a first recess, at least one portion of the rear end of the main plate of the main shielding shell is punched downward to form at least one buckling portion, the buckling portion is buckled in the first recess.

8. The electrical connector as claimed in claim 7, wherein a top surface of the main shielding shell is flush with a top surface of the protruding block.

9. The electrical connector as claimed in claim 1, wherein at least one portion of the top surface of the main body located behind the protruding block is recessed downward to form a second recess, a rear end of the main plate of the main shielding shell opens an opening, two inner sides of two opposite side walls of the opening are bent inward and downward to form two hooking portions, the two hooking portions hook two side walls of the second recess.

10. The electrical connector as claimed in claim 1, wherein rear ends of the two lateral plates of the main shielding shell extend rearward and then are bent inward to form two blocking arms, the two blocking arms block a rear surface of the main body.

11. The electrical connector as claimed in claim 1, further comprising a cover, the cover having a top plate, and a rear plate bent downward from a rear end of the top plate, at least one portion of the top plate being punched downward to form a convex portion, the main plate opening at least one fastening hole, the convex portion being fastened in the fastening hole.

12. The electrical connector as claimed in claim 11, wherein the cover has two side plates bent downward from two opposite sides of the top plate, each of the side plates opens at least one fixing groove, at least one portion of each of the two lateral plates is punched outward to form at least one fixing portion, the fixing portion is fixed in the fixing groove.

13. The electrical connector as claimed in claim 1, wherein the flanks are fastened to the main shielding shell by laser welding.

* * * * *